US009825377B2

(12) United States Patent
Nishikawa et al.

(10) Patent No.: US 9,825,377 B2
(45) Date of Patent: Nov. 21, 2017

(54) CONDUCTING MEMBER

(71) Applicant: NIPPON LIGHT METAL COMPANY, LTD., Tokyo (JP)

(72) Inventors: Yosuke Nishikawa, Shizuoka (JP); Manabu Okubo, Tokyo (JP); Yuichi Tamaki, Inazawa (JP); Kei Iwasaki, Inazawa (JP)

(73) Assignee: NIPPON LIGHT METAL COMPANY, LTD., Tokyo (JP)

( * ) Notice: Subject to any disclaimer, the term of this patent is extended or adjusted under 35 U.S.C. 154(b) by 0 days.

(21) Appl. No.: 14/784,832

(22) PCT Filed: May 29, 2014

(86) PCT No.: PCT/JP2014/064259
§ 371 (c)(1),
(2) Date: Oct. 15, 2015

(87) PCT Pub. No.: WO2014/192869
PCT Pub. Date: Dec. 4, 2014

(65) Prior Publication Data

US 2016/0064836 A1 Mar. 3, 2016

(30) Foreign Application Priority Data

May 29, 2013 (JP) ..... 2013-113451

(51) Int. Cl.
*H01R 4/62* (2006.01)
*H01R 13/03* (2006.01)
(Continued)

(52) U.S. Cl.
CPC ..... *H01R 4/62* (2013.01); *H01B 1/02* (2013.01); *H01B 5/02* (2013.01); *H01R 3/08* (2013.01); *H01R 4/304* (2013.01); *H01R 13/03* (2013.01)

(58) Field of Classification Search
CPC ... H01R 4/62; H01R 4/58; H01R 4/56; H01R 13/03; H01R 4/04; H01R 4/30–4/46;
(Continued)

(56) References Cited

U.S. PATENT DOCUMENTS 4,091,145 A * 5/1978 Endo ..... G03G 5/102 427/199
5,022,462 A * 6/1991 Flint ..... H01L 23/4338 165/185
(Continued)

FOREIGN PATENT DOCUMENTS

CN 103066475 A 4/2013
JP 45-2952 B 1/1970
(Continued)

OTHER PUBLICATIONS

Machine Translation of WO2010/152522A1 (2010).*
(Continued)

*Primary Examiner* — Scott R Walshon
(74) *Attorney, Agent, or Firm* — Birch, Stewart, Kolasch & Birch, LLP

(57) ABSTRACT

A conductive member of the present invention includes: a metallic conductive base material including a joining region to be joined to another conductive member when the conductive member is used; and a conductive-auxiliary-coating-agent layer for imparting conductivity and an oxidation preventing property to a joining section between the joining region and another conductive member when the conductive member is used, the conductive-auxiliary-coating-agent layer being formed by applying a conductive auxiliary coating agent to the joining region of the conductive base material, in which the joining region of the conductive base
(Continued)

material has a surface roughness of 0.6 μm or less in terms of an arithmetic mean roughness Ra specified in JISB0601 (1994).

13 Claims, 3 Drawing Sheets

(51) Int. Cl.
*H01B 1/02* (2006.01)
*H01B 5/02* (2006.01)
*H01R 3/08* (2006.01)
*H01R 4/30* (2006.01)

(58) Field of Classification Search
CPC ... H01B 5/02; H01B 5/04; H01B 1/02; H01B 1/023; H01B 1/026; Y10T 428/14; Y10T 428/1471; Y10T 428/1476
USPC ..... 174/68.2; 428/121, 334, 335, 469
See application file for complete search history.

(56) References Cited

U.S. PATENT DOCUMENTS 5,791,485 A * 8/1998 Carbonneau ..... B65D 31/02 206/204
7,528,413 B2 * 5/2009 Yoshida ..... C04B 35/52 257/712
9,093,778 B2 7/2015 Pillet
2003/0112603 A1 * 6/2003 Roesner ..... H01L 23/42 361/719
2012/0270002 A1 * 10/2012 Horiguchi ..... C09J 7/0225 428/41.5

FOREIGN PATENT DOCUMENTS

JP 2-291681 A 12/1990
JP 8-34263 A 2/1996
JP 2009-60757 A 3/2009
WO WO 2010/150522 A1 12/2010
WO WO 2012/007701 A1 1/2012

OTHER PUBLICATIONS

International Preliminary Report on Patentability and English translation of the Written Opinion of the International Searching Authority (Forms PCT/IB/338, PCT/IB/373 and PCT/ISA/237), dated Dec. 10, 2015, for International Application No. PCT/JP2014/064259.
International Search Report, issued in PCT/JP2014/064259, dated Jul. 1, 2014.
European Patent Office Communication and extended search report issued in the corresponding European Patent Application No. 14803726.0 dated Feb. 8, 2017.
Lalankere et al., "A Simulation and Experimental Based Study of Aluminium Busbars in LV Switchboard," Nov. 30, 2011, Retrieved from the Internet: URL: https://www.researchgate.net/profile/Manan-Deb/publication/258994198_A_Simulation_and_Experimental_Based_Study_of_Aluminium_Busbars_in_LV_Switchboard/links/00b7d52cc5c847ba34000000/A-Simulation-and-Experimental-Based-Study-of-Aluminium-Busbars-in-LV-Switchboard.pdf, retrieved on Jan. 26, 2017.

* cited by examiner

[Fig. 1A]
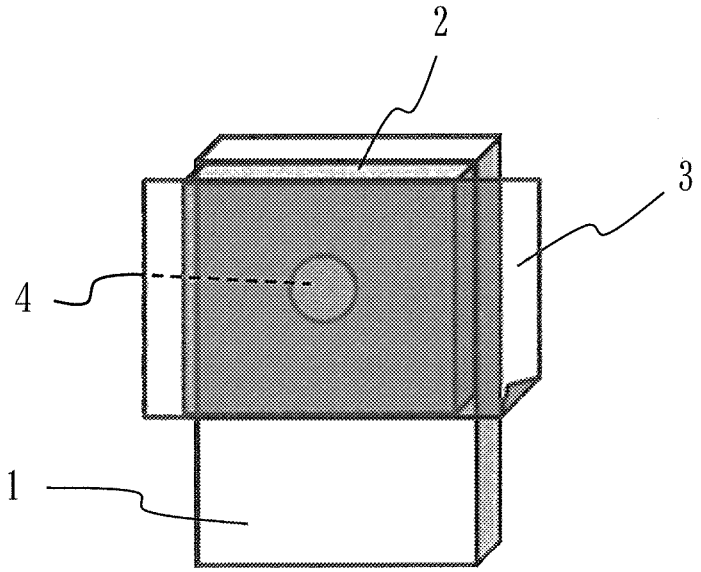
[Fig. 1B]
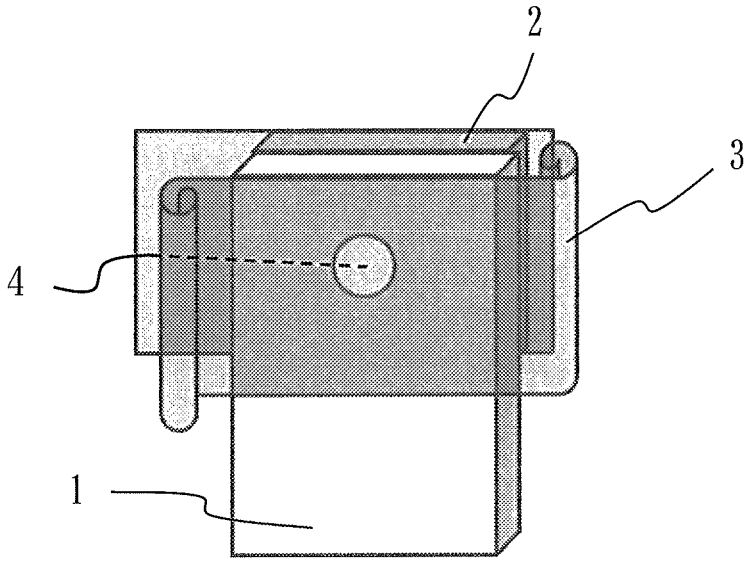

[Fig. 2A]
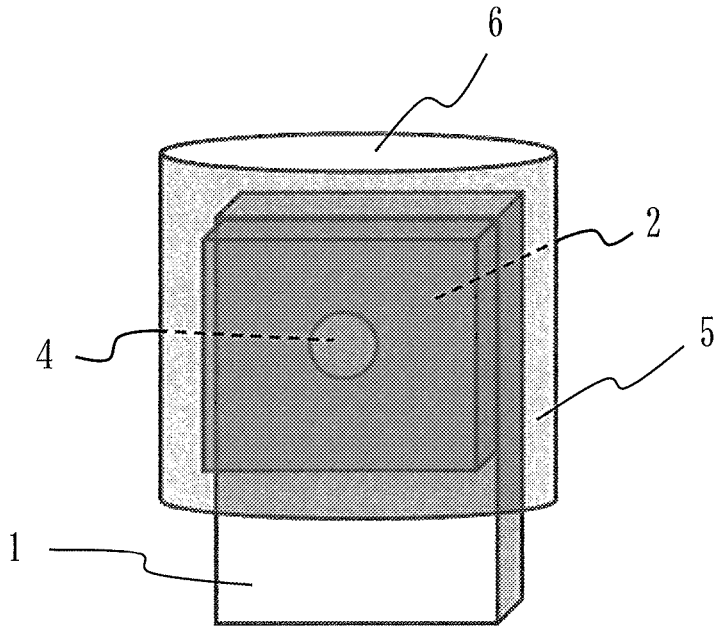
[Fig. 2B]
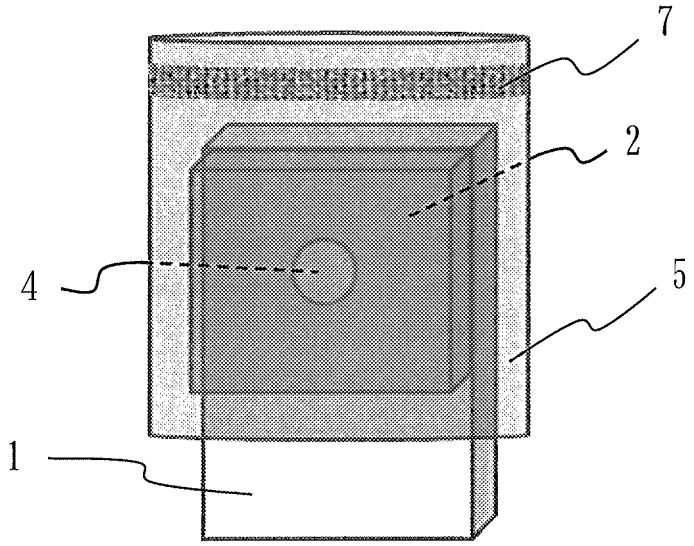

[Fig. 3A]
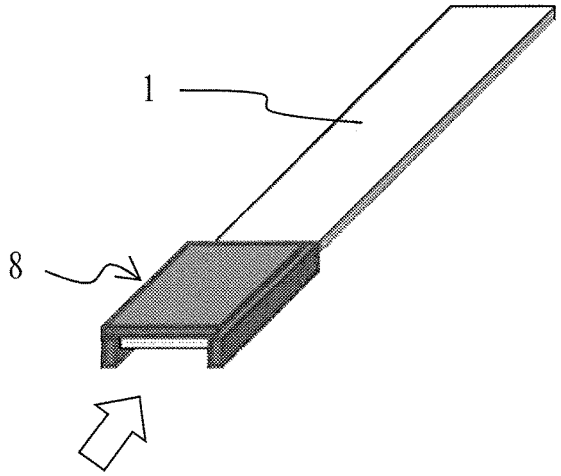
[Fig. 3B]
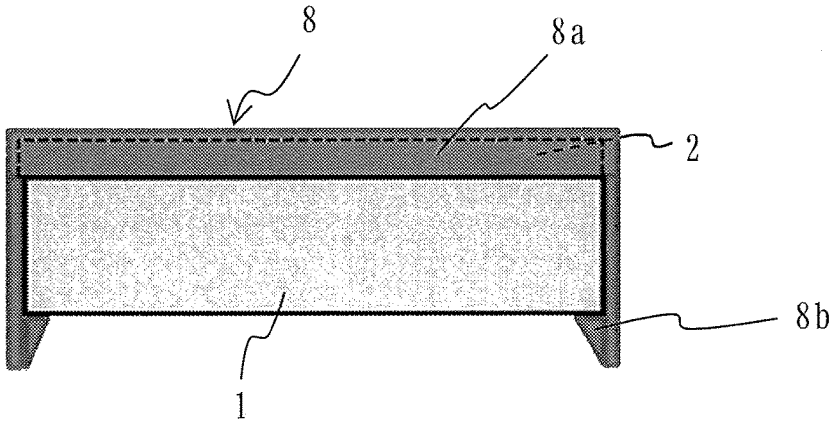

CONDUCTING MEMBER

TECHNICAL FIELD

The present invention relates to a conductive member to be used as a bus bar, a bus duct, or the like to be incorporated into various devices for receiving and distributing electric power, controlling devices, and the like in a power demand place such as an electric power station, an electric booster station, or a plant or into electric equipment such as a motor unit or an inverter case of a moving vehicle such as an automobile (including an electric automobile, a fuel-cell car, and a hybrid automobile), an electric train, an electric motorcycle, or an electric forklift truck.

BACKGROUND ART

When supplying electric power generated in an electric power station, or the like, there are used a transformer for reducing a voltage, a distribution board for distributing the electric power, and the like. The transformer, the distribution board, and the like each use a device for receiving and distributing the electric power, a controlling device such as a switch, and the like, in order to receive and distribute the electric power at a large capacity and a low voltage. In addition, the device for receiving and distributing the electric power, the controlling device, and the like each use a bus bar or a conductive member called a bus duct, in which a plurality of such bus bars are stacked (for example, Patent Literature 1).

For the conductive member, a copper-based material formed of copper or a copper alloy is mainly used because the copper-based material exhibits excellent performance in conductivity, strength, processability, corrosion resistance, and the like. However, in recent years, copper has increased in price owing to, for example, concern about depletion of copper resources. In addition, by its nature, the copper-based material is heavy in weight owing to, for example, copper having a density of 8.95 g/cm$^3$ (20° C.) as compared to an aluminum material formed of aluminum or an aluminum alloy (for example, pure aluminum has a density of 2.699 g/cm$^3$ (20° C.)). For those and other reasons, in all electricity-related fields, the aluminum material, which has a light weight, is easy to handle, and has excellent conductivity, has begun to attract attention as an alternative to the copper-based material.

However, a highly reactive metal such as aluminum has a property of being easily oxidized in its surface. For example, when the aluminum material is exposed to external air, its surface is immediately oxidized and a natural oxide film (aluminum oxide) is formed. Further, in an aluminum material subjected to hot plastic processing steps such as rolling, extrusion, and forging, a relatively thick and stiff thermal oxide film is formed on its surface. In the case where conductive members are manufactured through use of such aluminum material, electric resistance increases due to the oxide film formed on the surface to inhibit conductivity, and a problem of heat generation occurs particularly in a connecting section between the conductive members when a large-capacity current flows. Further, when the conductive member having the oxide film formed thereon is left in a high-temperature and high-humidity environment, the thickness of the oxide film gradually increases, and the oxide film and moisture react with each other to form a hydrate (hydrate film); with the result that electric resistance increases with time to cause trouble in an application of the conductive member.

Therefore, in a worksite where the conductive member made of the aluminum material is used, for example, when the conductive member is joined to a terminal serving as a joining target, or the like, an oxide film formed in a joining region of the conductive member is removed with a wire brush, or the like immediately before operations. Then, a conductive auxiliary coating agent, for example, conductive auxiliary grease obtained by mixing conductive auxiliary powder such as chromium oxide into grease is applied to the joining region of the conductive member, and the conductive member is joined to another conductive member through intermediation of the conductive auxiliary grease (Patent Literature 2). However, when all the operations are performed at the worksite, there is a problem in that not only operation efficiency but also operation quality is degraded, with the result that the quality of a conductive member to be obtained is degraded. That is, it was difficult to uniformly remove the oxide film and quantitatively manage the removed state of the oxide film at the worksite. In particular, the thermal oxide film was thick and stiff, and hence it was difficult to remove the thermal oxide film. Further, the surface roughness of the joining region was liable to increase. Further, in the application operation of the conductive auxiliary grease performed after the removing operation of the oxide film, it was also difficult to uniformly apply the conductive auxiliary grease and it was not even possible to quantitatively manage the application amount of the conductive auxiliary grease. In order to solve the above-mentioned problems, it has been considered to form a conductive member having the conductive auxiliary coating agent such as conductive auxiliary grease applied thereto in advance.

Meanwhile, the conductive auxiliary coating agent contains insulating grease as a main component, and hence contact resistance increases when another conductive member serving as a joining target or the like is joined to the conductive auxiliary coating agent in the case where the application thickness thereof is large. Therefore, in the case where a conductive member is joined to another conductive member or the like through intermediation of the conductive auxiliary coating agent, the following measures are frequently taken. Specifically, a contact surface pressure of the joining is increased to firmly join the conductive members to each other so that the conductive auxiliary coating agent is discharged properly from between the joined members to decrease the thickness of the conductive auxiliary coating agent.

However, when the contact surface pressure is increased, in the case where the strength of the conductive member or a fastening bolt is insufficient, there is a risk in that the buckling or deformation of the conductive member, the fracturing of the bolt, or the like may occur. In order to reduce the contact resistance by increasing the contact surface pressure without causing the above-mentioned problems, it is necessary to increase the contact surface pressure by enhancing a fastening pressure through use of bolts and nuts having a large fastening torque and increasing the number of bolts and nuts. Therefore, it is difficult to apply the conductive auxiliary coating agent to a small conductive member. That is, in the case of applying the conductive auxiliary coating agent to a conductive member to be used as, for example, a small bus bar for an automobile or the like, it is necessary to reduce the contact resistance by decreasing the thickness of a conductive-auxiliary-coating-agent layer after fastening even in a fastening torque of from 2 N·m to 10 N·m in the case of using bolts and nuts with a small diameter having a relatively low fastening toque, for example, in the case of using an air-driven or electric impact wrench. However, in the case where the surface roughness of the surface of a conductive base material is large, when the thickness of the conductive auxiliary coating agent is small, a gap through which oxygen and moisture enter remains in a fastening section. In this case, there is a risk in that the absolute amount of the conductive auxiliary coating agent may become insufficient, and oxygen and the like may enter a fastening surface of the conductive member to cause oxidation of the fastening surface to proceed, with the result that the contact resistance of the conductive member increases with time to make it impossible to keep sufficient conductivity.

Further, in the case where the conductive member having the conductive auxiliary coating agent applied thereto as described above is used in such a manner as to be stored or distributed as it is, there is a risk in that the applied conductive auxiliary coating agent may be lost or contaminated to become unsuitable for use due to contact with another object, the adhesion of foreign matters such as grit and dust to the conductive auxiliary coating agent, or the like. Further, there is also another problem in that the conductive auxiliary coating agent may contaminate another object that the conductive auxiliary coating agent is brought into contact.

CITATION LIST

Patent Literature

[PTL 1] JP 2009-060757 A
[PTL 2] JP 45-2952 B

SUMMARY OF INVENTION

Technical Problem

As a result of earnestly conducting investigations in order to solve the above-mentioned problems, the inventors of the present invention have found the following. The thickness of a conductive auxiliary coating agent to be formed can be relatively decreased to obtain sufficient conductivity and sustainability thereof, and the contact resistance can be stably kept low, without increasing the contact surface pressure in the case of joining a conductive member to another conductive member, by subjecting a conductive base material to a required removing operation of an oxide film and a required application operation of a conductive auxiliary coating agent to form in advance a conductive-auxiliary-coating-agent layer on the conductive base material, and setting the surface roughness of a joining region of the conductive base material to which the conductive auxiliary coating agent is applied within a predetermined range. Further, the inventors of the present invention have also found the following. In the case where the conductive member having the conductive-auxiliary-coating-agent layer is used in such a manner as to be stored or distributed as it is, the formed conductive-auxiliary-coating-agent layer is prevented from being contaminated or broken by protecting the conductive-auxiliary-coating-agent layer with a protective cover in advance. Further, the conductive member can be joined to another conductive member simply and quickly through an operation of merely removing the protective cover at a worksite, and hence the operability is satisfactory. Further, the oxide film removed state and surface roughness of the conductive base material, the coated state of the conductive auxiliary coating agent, and the like can be managed constantly in advance. With this, the conductivity and the oxidation preventing property required for use as a bus bar, a bus duct, or the like can be expressed reliably. Thus, the inventors of the present invention have achieved the present invention.

Accordingly, it is an object of the present invention to provide a stable-quality conductive member in which: even in a small conductive member in which the contact surface pressure cannot be increased, the thickness of a conductive-auxiliary-coating-agent layer after joining the conductive member to another conductive member or the like can be relatively decreased to obtain sufficient conductivity and stability thereof, and the contact resistance can be stably kept low; in the case where the conductive member having the conductive-auxiliary-coating-agent layer is used in such a manner as to be stored or distributed as it is, the conductive-auxiliary-coating-agent layer formed on a base material can be prevented from being contaminated or broken; further, the operability of joining the conductive member to another conductive member is satisfactory; and further, desired conductivity and a desired oxidation preventing property can be expressed reliably.

Solution to Problem

That is, according to one embodiment of the present invention, there is provided a conductive member, including: a metallic conductive base material including a joining region to be joined to another conductive member when the conductive member is used; and a conductive-auxiliary-coating-agent layer for imparting conductivity and an oxidation preventing property to a joining section between the joining region and the another conductive member when the conductive member is used, the conductive-auxiliary-coating-agent layer being formed by applying a conductive auxiliary coating agent to the joining region of the conductive base material, in which the joining region of the conductive base material has a surface roughness of 0.6 μm or less in terms of an arithmetic mean roughness Ra specified in JISB0601 (1994).

In addition, in the conductive member of the present invention, it is preferred that the conductive-auxiliary-coating-agent layer have a thickness of 100 μm or less.

In addition, in the conductive member of the present invention, it is preferred that the conductive-auxiliary-coating-agent layer include a protective cover that is formed so as to cover and protect the conductive-auxiliary-coating-agent layer and that is removed when the conductive member is used.

In addition, in the conductive member of the present invention, it is preferred that a material for the conductive base material include aluminum or an aluminum alloy.

In addition, in the conductive member of the present invention, it is preferred that the joining region of the conductive base material be subjected to oxide film removing treatment by chemical etching or mechanical processing before the conductive-auxiliary-coating-agent layer is formed.

In addition, in the conductive member of the present invention, it is preferred that the conductive auxiliary coating agent include conductive auxiliary grease containing one or two or more powders selected from the group consisting of chromium oxide, zinc, silicon carbide, and a bismuth-tin alloy.

In addition, in the conductive member of the present invention, it is preferred that the conductive-auxiliary-coating-agent layer have a thickness of from 10 μm to 40 μm.

In addition, in the conductive member of the present invention, it is preferred that the protective cover include a release sheet formed into a film shape or a sheet shape to be releasably bonded to the conductive-auxiliary-coating-agent layer.

In addition, in the conductive member of the present invention, it is preferred that the protective cover cover an entire surface of a joining surface and a side surface of the conductive-auxiliary-coating-agent layer.

In addition, in the conductive member of the present invention, it is preferred that the protective cover include a guarding sheet for covering and protecting the joining region of the aluminum conductive base material and the conductive-auxiliary-coating-agent layer formed on the joining region, the guarding sheet being formed into a tubular shape opened at both ends or a bag shape opened at one end.

Further, in the conductive member of the present invention, it is preferred that the protective cover include a guarding cover including a covering section for covering an entire surface of the conductive-auxiliary-coating-agent layer and a locking section for detachably locking the covering section to the conductive base material.

Advantageous Effects of Invention

In the conductive member according to the present invention, the conductive-auxiliary-coating-agent layer is formed in advance on the conductive base material. Therefore, the conductive member can be joined to another conductive member simply and quickly at a worksite, and hence the operability is satisfactory. Further, the surface roughness (arithmetic mean roughness) Ra of the conductive base material having the conductive-auxiliary-coating-agent layer formed thereon is set within a predetermined range. Therefore, even in a small conductive member in which the contact surface pressure cannot be increased, the thickness of the conductive-auxiliary-coating-agent layer after joining the conductive member to another conductive member or the like can be relatively decreased to keep sufficient conductivity, and the contact resistance can be stably kept low. Further, even in the case where the conductive member having the conductive-auxiliary-coating-agent layer is used in such a manner as to be stored or distributed as it is, the formed conductive-auxiliary-coating-agent layer is not contaminated or broken during the storage or distribution by virtue of the protective cover for protecting the conductive-auxiliary-coating-agent layer. Further, when the conductive member is used at the worksite, the conductive member can be joined to another conductive member simply and quickly through an operation of merely removing the protective cover, and hence the operability is satisfactory. Further, the conductive member is also excellent in required conductivity and oxidation preventing property, and hence the conductive member is suitably used as a bus bar, a bus duct, or the like.

BRIEF DESCRIPTION OF DRAWINGS

FIG. 1A is an explanatory view for illustrating a conductive member in which a release sheet (protective cover) is bonded to only a joining surface of conductive-auxiliary-coating-agent layer.

FIG. 1B is an explanatory view for illustrating a conductive member in which an entire surface of the joining surface and a side surface of the conductive-auxiliary-coating-agent layer is covered with the release sheet (protective cover).

FIG. 2A is an explanatory view for illustrating a conductive member in which the conductive-auxiliary-coating-agent layer is covered with a guarding sheet having a tubular shape opened at both ends.

FIG. 2B is an explanatory view for illustrating a conductive member in which the conductive-auxiliary-coating-agent layer is covered with a guarding sheet having a bag shape opened at one end.

FIG. 3A is a perspective view for illustrating a conductive member in which the conductive-auxiliary-coating-agent layer is covered with a guarding cover.

FIG. 3B is a sectional view of the conductive member of FIG. 3A when viewed from a direction denoted by a white arrow.

DESCRIPTION OF EMBODIMENTS

Now, preferred embodiments of the present invention are described specifically.

In the present invention, a conductive base material serving as a basis material is a metal having conductivity, which is impaired due to the formation of an oxide film on a surface in various environments, and examples thereof include but are not limited to an aluminum material formed of aluminum or an aluminum alloy, a copper material formed of copper or a copper alloy, and an iron material formed of iron or an iron alloy. The conductive base material can be selected based on the application of a conductive member to be formed through use of the conductive base material, and various physical properties such as conductivity, strength, corrosion resistance, and processability required in the application. In the case of using an aluminum material, a 1,000-series (pure Al series) excellent in conductivity or a 6,000-series (Al—Mg—Si series) that is inferior in conductivity to the 1,000-series but that has high strength and is also excellent in formability is preferred. The conductive base material can be manufactured by, for example, a method involving casting, extrusion, rolling, or forging.

Further, according the present invention, in a joining region that is formed on a surface of the conductive base material and is joined to another conductive member, it is preferred that an oxide film formed on the joining region be removed in advance. The removing treatment of the oxide film can be appropriately selected based on the kind, thickness, and the like of the oxide film, and for example, there may be given chemical etching treatment or mechanical processing treatment. When the oxide film that inhibits electric resistance is removed, the passage of an electric current between the conductive member and another conductive member when the conductive member is used becomes satisfactory. Further, the amount of oxygen remaining in a void section of a contact surface between the conductive base material and a conductive auxiliary coating agent to be described later can be reduced by smoothening the joining region to the extent possible to improve the adhesiveness of the joining region with respect to the conductive auxiliary coating agent. Thus, the oxide film is not formed easily even when the conductive member is used, and an increase in electric resistance caused by the formation of the oxide film is less liable to occur. As the chemical etching, for example, there may be given alkaline treatment and alkali phosphate treatment using an alkaline solution. Specifically, in the case of the alkaline treatment, at least one kind of alkaline aqueous solution selected from sodium hydroxide, potassium hydroxide, and lithium hydroxide having a concentration of from 30 g/L to 200 g/L can be used. Further, in the case of the alkali phosphate treatment, at least one kind of alkali phosphate aqueous solution selected from sodium hydroxide, sodium phosphate, and potassium hydroxide having a concentration of from 30 g/L to 100 g/L can be used. Further, as the mechanical processing treatment, a method such as polishing, grinding, cutting, shotblasting, or wet blasting can be used. It should be noted that in the case where a smut is formed on a surface of the base material by the chemical etching treatment, for example, desmutting treatment may be performed by acid treatment using an acid aqueous solution.

In addition, after the removing treatment of the oxide film is performed, a conductive auxiliary coating agent for imparting required conductivity and a required oxidation preventing property to a joining section between the joining region and another conductive member is applied to the joining region to form a conductive-auxiliary-coating-agent layer on the joining region. As the conductive auxiliary coating agent, for example, there may be given grease containing one or two or more conductive powders or conductive auxiliary powders selected from the group consisting of chromium oxide, zinc, silicon carbide, and a bismuth-tin alloy in grease serving as a base (for example, trade name "NIKKEI JOINTAL" manufactured by Shizuoka Kosan Co., Ltd.) and a conductive auxiliary coating agent obtained by adding a conductive filler and as required an oxidation preventing agent or the like to a binder resin, followed by mixing (see, for example, JP 2005-26187 A, JP 2007-317489 A, or JP 2010-539650 A). Further, as preferred characteristics of the conductive auxiliary coating agent, it is preferred that the consistency specified in JIS-K2220 be from 290 to 340 from the viewpoint of a discharging property from the joining section. Further, it is preferred that the flash point specified in JIS-K2220 be 200° C. or more, and the dropping point fall within a range of from 160° C. to 210° C., from the viewpoint of aging degradation.

Herein, in the present invention, the surface roughness of a coated surface (joining region) of the conductive base material to which the conductive auxiliary coating agent is applied is 0.6 μm or less, preferably 0.2 μm or less in terms of an arithmetic mean roughness Ra specified in JISB0601 (1994). In the present invention, as described above, in order to obtain a conductive member that can be used also as, for example, a small bus bar for an automobile or the like, it is necessary to decrease the thickness of the conductive-auxiliary-coating-agent layer to be formed so as to reduce the contact resistance even in the case where the contact surface pressure is relatively low (for example, contact surface pressure: 52.4 kgf/cm$^2$ or less). Therefore, when the surface roughness (arithmetic mean roughness Ra) of the coated surface (joining region) of the conductive base material to which the conductive auxiliary coating agent is applied is set within the above-mentioned range, even in the case where the contact surface pressure is relatively low, the conductive auxiliary coating agent can be discharged properly from between the joined members in the case where the conductive member of the present invention is joined to another conductive member, and thus the thickness of the conductive auxiliary coating agent can be decreased to reduce the contact resistance. In the case where the surface roughness is more than 0.6 μm, the discharging property of the applied conductive auxiliary coating agent is not sufficient, and the contact resistance increases, with the result that sufficient conductivity and sustainability thereof cannot be obtained. It should be noted that the joining surface of another conductive member or the like to be joined to the conductive member of the present invention preferably satisfies the above-mentioned surface roughness. Although the absolute value of the contact resistance varies depending on the size and contact surface pressure of the conductive member, it is preferred that a resistance ratio obtained by dividing the contact resistance value of the conductive member after the application of the conductive auxiliary coating agent by the contact resistance value of only the conductive base material before the application of the coating agent be less than 2.5 (more preferably less than 2.0).

In addition, as a method of setting the surface roughness (arithmetic mean roughness Ra) of the coated surface (joining region) of the conductive base material to which the conductive auxiliary coating agent is applied as described above, for example, there may be given rolling processing using a roll having its roughness adjusted, extrusion processing, or cutting processing.

Further, the thickness of the conductive-auxiliary-coating-agent layer formed by applying the conductive auxiliary coating agent is preferably 100 μm or less, more preferably from 10 μm to 40 μm. It is not preferred that the thickness be more than 100 μm because the distance between the conductive members to be joined through intermediation of the conductive-auxiliary-coating-agent layer increases, and a large contact surface pressure is required for obtaining sufficient conductivity. On the other hand, it is not preferred that the thickness be less than 10 μm for the following reason. The amount of the conductive auxiliary coating agent to be held when the conductive member is joined to another member becomes small, and hence water-tightness and air-tightness of the joining section become insufficient. As a result, there is a risk in that moisture and oxygen enter the joining section (joining surface of the conductive member) to form an oxide film when the conductive member is used, thereby decreasing conductivity, and irregularities are liable to occur in the thickness of the conductive-auxiliary-coating-agent layer to cause variation in conductivity. It should be noted that it is more preferred that the conductive auxiliary coating agent be applied also to a counterpart member for joining, and the total thickness including the applied conductive auxiliary coating agent be 100 μm or less.

As a method of applying the conductive auxiliary coating agent, a known method can be adopted, and means such as a roll coating method, a bar coating method, a spraying method, or an immersion method can be used. More simply, a roller to be used in a general coating operation can be used.

Further, in the present invention, it is preferred that, after the conductive-auxiliary-coating-agent layer is formed on a surface of the conductive base material, the conductive-auxiliary-coating-agent layer be protected by being covered with a protective cover. As the protective cover, any cover may be used as long as the cover can prevent the conductive-auxiliary-coating-agent layer from being contaminated or broken during storage or distribution and can be easily removed when the conductive member is used. For example, there may be given a film-shaped or sheet-shaped release sheet that can be detachably bonded to the conductive-auxiliary-coating-agent layer, a guarding cover for covering an entire surface of the conductive-auxiliary-coating-agent layer, and other forms of protective covers. There is no particular limitation on the material for the protective cover, and a resin, a metal, ceramics, paper, or the like can be used.

As the manner of mounting of the protective cover on the conductive-auxiliary-coating-agent layer in the case where the protective cover is the above-mentioned release sheet, there may be given a case where the protective cover is merely releasably bonded only the joining surface of the conductive-auxiliary-coating-agent layer as illustrated in FIG. 1A, and a case where an entire surface of the joining surface and a side surface of the conductive-auxiliary-coating-agent layer is covered with the protective cover as illustrated in FIG. 1B. It is more preferred that the entire surface of the joining surface and the side surface of the conductive-auxiliary-coating-agent layer be covered with the protective cover as illustrated in FIG. 1B because the water-tightness and air-tightness of the joining section of the conductive-auxiliary-coating-agent layer during storage become more sufficient.

Further, as the manner of mounting of the release sheet, the release sheet can also be a guarding sheet having a tubular shape opened at both ends as illustrated in FIG. 2A or a bag shape opened at one end as illustrated in FIG. 2B. The above-mentioned manner of mounting of the release sheet is preferred because the entire joining region of the conductive base material and the entire conductive-auxiliary-coating-agent layer can be covered with the guarding sheet, and hence the water-tightness and air-tightness of the joining section of the conductive-auxiliary-coating-agent layer during storage can be further maintained. It should be noted that an opening of the guarding sheet can be closed by a method such as bonding with an adhesive, or thermal welding.

Further, in the case where the protective cover is the above-mentioned guarding cover, the guarding cover can be configured to include a covering section for covering the entire surface of the conductive-auxiliary-coating-agent layer and a locking section for detachably locking the covering section to the conductive base material, for example, as illustrated in FIG. 3.

Further, as a method of joining the conductive member of the present invention to another conductive member or the like, the conductive-auxiliary-coating-agent layer can be joined to a joining surface of another conductive member or the like to be joined to the conductive-auxiliary-coating-agent layer by a method such as ultrasonic joining, vibration welding, or caulking after the protective cover is removed. More simply, the conductive-auxiliary-coating-agent layer can be joined to another conductive member or the like by fastening with a bolt through a bolt fastening hole (4) as illustrated in FIG. 1A, FIG. 1B, FIG. 2A, and FIG. 2B. The contact surface pressure is preferably 76.8 kgf/cm$^2$ or less, more preferably from 26.4 kgf/cm$^2$ to 52.4 kgf/cm$^2$ in the case of a small conductive member.

EXAMPLES

The embodiments of the present invention are described based on the following test examples.

[Confirmation Test of Contact Resistance based on Surface Roughness of Conductive Base Material]

In order to confiuin the effect of a surface roughness (arithmetic mean roughness Ra) on contact resistance, the following test was conducted. An aluminum member having an oxide film formed on a surface was subjected to cold rolling processing so as to have a surface roughness Ra of 0.15 μm. After that, the resultant was subjected to cutting processing to prepare an aluminum conductive base material formed of a 6101-T6 aluminum (Al) material measuring 3 mm×50 mm×100 mm. Then, a conductive auxiliary coating agent (trade name"NIKKEI JOINTAL Z" manufactured by Shizuoka Kosan Co., Ltd.) was applied to a portion of the aluminum conductive base material corresponding to a joining region with respect to another conductive member (6101-T6 Al material), and the conductive auxiliary coating agent was rubbed with cotton waste to remove the surface oxide film. Then, the conductive auxiliary coating agent was again applied to the joining region to a thickness of 11 μm to obtain a conductive member. It should be noted that the surface roughness Ra after the surface oxide film was removed was 0.15 μm. Further, as another conductive member, a conductive member was also prepared by polishing a surface of a base material with emery paper so as to have a surface roughness Ra of from 0.4 μm to 1.0 μm.

Another conductive member (conductive member under the same condition) was joined to the obtained conductive member through intermediation of the conductive auxiliary coating agent, followed by fastening so as to obtain a contact surface pressure of 52.4 kgf/cm$^2$, to obtain aluminum test pieces according to Test Examples 1 to 5. A contact resistance ratio was measured under the following measurement conditions.

<Measurement Conditions of Contact Resistance Ratio>

Method: Four-terminal method

Electric current: 1 A

A voltage between the conductive member and another conductive member joined to the conductive member was measured twice each for different directions of the passage of an electric current. Measurement values of a total of four measurements were averaged to calculate a contact resistance ratio. It should be noted that the case where the measurement was conducted with the 6101-T6 Al material alone was set to 1.

TABLE 1

| | Surface roughness (μm) | Contact surface pressure (kgf/cm$^2$) | Coating thickness of conductive auxiliary coating agent (μm) | Resistance ratio (—) | Remark |
|---|---|---|---|---|---|
| Test Example 1 | 0.15 | 52.4 | 11 (22) | ◎ | Corresponding to Example |
| Test Example 2 | 0.3 | 52.4 | 11 (22) | Δ | Corresponding to Example |
| Test Example 3 | 0.4 | 52.4 | 11 (22) | Δ | Corresponding to Example |
| Test Example 4 | 0.5 | 52.4 | 11 (22) | Δ | Corresponding to Example |
| Test Example 5 | 1.0 | 52.4 | 11 (22) | X | Corresponding to Comparative Example |

*It should be noted that the numerical values in parentheses of the coating thickness indicate the total coating thickness of the conductive auxiliary coating agents of the two conductive members to be joined to each other.

[Determination Criterion of Resistance Ratio]

◎: The resistance ratio is less than 2, and conductivity is satisfactory.

○: The resistance ratio is 2 or more and less than 2.5, and conductivity is sufficient.

Δ: Although the resistance ratio is 2.5 or more and less than 3.0, and conductivity is slightly insufficient, there is no significant problem for use.

x: The resistance ratio is 3.0 or more, and conductivity is insufficient.

As shown in Table 1, it is understood that, in the conductive member according to Test Example 1 having a surface roughness Ra of 0.15 μm, the resistance ratio was less than 2, and thus satisfactory conductivity was obtained. Further, it is understood that, in each of the conductive members according to Test Examples 2 to 4 having a surface roughness Ra of more than 0.2 μm and 0.6 μm or less, the resistance ratio was less than 3.0, and thus sufficient conductivity was obtained. In contrast, it is understood that, in Test Example 5 having a surface roughness Ra of 1.0 μm corresponding to a Comparative Example, the resistance ratio was 3.0 or more, and thus sufficient conductivity was not obtained.

[Confirmation Test of Contact Resistance based on Thickness of Conductive-auxiliary-coating-agent Layer]

In order to confirm the effect of the thickness of a conductive-auxiliary-coating-agent layer on the contact resistance, the following test was conducted. An aluminum member having an oxide film formed on a surface was subjected to cold rolling processing so as to have a surface roughness Ra of 0.15 μm. After that, the resultant was subjected to cutting processing to prepare an aluminum conductive base material formed of a 6101-T6 aluminum (Al) material measuring 3 mm×50 mm×100 mm. Then, a conductive auxiliary coating agent (trade name "NIKKEI JOINTAL Z" manufactured by Shizuoka Kosan Co., Ltd.) was applied to a portion of the aluminum conductive base material corresponding to a joining region with respect to another conductive member (6101-T6 Al material), and the conductive auxiliary coating agent was rubbed with cotton waste to remove the surface oxide film. Then, the conductive auxiliary coating agent was again applied to the joining region to each thickness shown in Table 2 to obtain a conductive member. It should be noted that the surface roughness Ra after the surface oxide film was removed was 0.15 μm.

Another conductive member (conductive member under the same condition) was joined to the obtained conductive member in the same way as above to obtain aluminum test pieces according to Test Examples 6 to 10. After that, a contact resistance ratio was measured under the same measurement conditions as above.

TABLE 2

| | Surface roughness (μm) | Contact surface pressure (kgf/cm$^2$) | Coating thickness of conductive auxiliary coating agent (μm) | Resistance ratio (—) | Remark |
|---|---|---|---|---|---|
| Test Example 6 | 0.15 | 52.4 | 11 (22) | ◎ | Corresponding to Example |
| Test Example 7 | 0.15 | 52.4 | 14 (28) | ◎ | Corresponding to Example |
| Test Example 8 | 0.15 | 52.4 | 21 (42) | ○ | Corresponding to Example |
| Test Example 9 | 0.15 | 52.4 | 33 (66) | ○ | Corresponding to Example |
| Test Example 10 | 0.15 | 52.4 | 66 (132) | Δ | Corresponding to Example |

*1 It should be noted that the numerical values in parentheses of the coating thickness indicate the total coating thickness of the conductive auxiliary coating agents of the two conductive members to be joined to each other.
*2 The determination criterion of the resistance ratio is the same as that in the case of Table 1.

As shown in Table 2, it is understood that, in each of the conductive members having a total coating thickness of the conductive auxiliary coating agents of 40 μm or less according to Test Examples 6 and 7, the resistance ratio was less than 2, and thus satisfactory conductivity was obtained. Further, it is understood that, in each of the conductive members having a total coating thickness of the conductive auxiliary coating agents of from 40 μm to 100 μm according to Test Examples 8 and 9, the resistance ratio was 2 or more and less than 2.5, and thus sufficient conductivity was obtained. Further, in the conductive member having a total coating thickness of the conductive auxiliary coating agents of 132 μm according to Test Example 10, although the resistance ratio was 2.5 or more and less than 3.0, and conductivity was slightly insufficient, there was no significant problem for use.

[Confirmation Test of State and Conductivity of Conductive Auxiliary Coating Agent based on Protective Cover]

Test Example 11

An aluminum member having an oxide film formed on a surface was subjected to cold rolling processing so as to have a surface roughness Ra of 0.15 μm. After that, the resultant was subjected to cutting processing to prepare an aluminum conductive base material formed of an A1050 aluminum (Al) material measuring 6 mm×50 mm×200 mm. Then, a conductive auxiliary coating agent (trade name "NIKKEI JOINTAL Z" manufactured by Shizuoka Kosan Co., Ltd.) was applied to a portion of the aluminum conductive base material corresponding to a joining region with respect to another conductive member (A1050 Al material), and the conductive auxiliary coating agent was rubbed with cotton waste to remove the surface oxide film. Then, the conductive auxiliary coating agent was again applied to the joining region to a thickness of 11 μm to obtain a conductive member. It should be noted that the surface roughness Ra after the surface oxide film was removed was 0.15 μm.

Next, a release sheet (protective cover) formed of polyethylene terephthalate (PET) was bonded to a joining surface of the thus formed conductive-auxiliary-coating-agent layer so as to protect the joining surface, and thus a test piece (aluminum conductive member) was produced.

After the obtained test piece was stored for a while, the release sheet was removed so as to check the state of the conductive-auxiliary-coating-agent layer. Consequently, the breakage and the adhesion of foreign matters were not recognized. Further, the conductivity of a joining section, which was joined to another conductive member (A1050 Al material) having a conductive auxiliary coating agent with a coating thickness of 11 μm applied thereto in the same way as above through bolt fastening, was checked with a tester, and a satisfactory passage of an electric current was confirmed. The results are shown together in Table 3.

Test Example 12

An aluminum member having an oxide film formed on a surface was subjected to cold rolling processing so as to have a surface roughness Ra of 0.15 μm. After that, the resultant was subjected to cutting processing to prepare an aluminum conductive base material formed of an A6101 Al material measuring 6 mm×50 mm×200 mm. Then, a portion of the aluminum conductive base material corresponding to a joining region with respect to another conductive member (copper material) was subjected to grinding treatment with a grinder to remove the oxide film. A conductive auxiliary coating agent (trade name "NIKKEI JOINTAL Z" manufactured by Shizuoka Kosan Co., Ltd.) was applied to the portion from which the oxide film had been removed, and the conductive auxiliary coating agent was rubbed with cotton waste to remove the surface oxide film. Then, the conductive auxiliary coating agent was again applied to the joining region to a thickness of 11 μm to obtain a conductive member. It should be noted that the surface roughness Ra after the surface oxide film was removed was 0.15 μm.

Next, a release sheet (protective cover) formed of an aluminum foil was bonded to a joining surface of the thus formed conductive-auxiliary-coating-agent layer so as to protect the joining surface, and thus a test piece (aluminum conductive member) was produced.

After the obtained test piece was stored for a while, the release sheet was removed so as to check the state of the conductive-auxiliary-coating-agent layer. Consequently, the breakage and the adhesion of foreign matters were not recognized. Further, the conductivity of a joining section, which was joined to another conductive member (copper material) having a conductive auxiliary coating agent with a coating thickness of 11 μm applied thereto through bolt fastening, was checked with a tester, and a satisfactory passage of an electric current was confirmed. The results are shown together in Table 3.

Test Example 13

A test piece (aluminum conductive member) according to Test Example 13 was produced in the same way as in Test Example 11 except that the thickness of a conductive-auxiliary-coating-agent layer to be formed was set to 44 μm. Then, in the same way as in Test Example 11, after the obtained test piece was stored for a while, the release sheet was removed so as to check the state of the conductive-auxiliary-coating-agent layer. Consequently, the breakage and the adhesion of foreign matters were not recognized. Further, in the same way as in Test Example 11, the conductivity of a joining section, which was joined to another conductive member (A1050 Al material) through bolt fastening, was checked with a tester, and a satisfactory passage of an electric current was confirmed. The results are shown together in Table 3.

TABLE 3

| | Conductive base material | Another conductive member | Method of removing oxide film | Thickness of conductive-auxiliary-coating-agent layer | Protective cover | Conductivity after joining |
|---|---|---|---|---|---|---|
| Test Example 11 | A1050 Al | A1050 Al | Alkali etching | 11 (22) μm | PET sheet | Satisfactory |
| Test Example 12 | A6101 Al | Cu | Grinding with grinder | 11 (22) μm | Al foil | Satisfactory |
| Test Example 13 | A1050 Al | A1050 Al | Alkali etching | 44 (88) μm | PET sheet | Satisfactory |

*It should be noted that the numerical values in parentheses of the coating thickness indicate the total coating thickness of the conductive auxiliary coating agents of the two conductive members to be joined to each other.

REFERENCE SIGNS LIST

1 . . . conductive base material, 2 . . . conductive-auxiliary-coating-agent layer, 3 . . . release sheet (protective cover), 4 . . . bolt fastening hole, 5 . . . guarding sheet (protective cover), 6 . . . opening, 7 . . . bonded portion, 8 . . . guarding cover, 8*a* . . . covering section, 8*b* . . . locking section

The invention claimed is:

1. A bus bar, comprising:

a metallic conductive base material including a joining region to be joined to another conductive member when the bus bar is used; and an electrically conductive-auxiliary-coating-agent layer for imparting conductivity and an oxidation preventing property to a joining section between the joining region and the another conductive member when the bus bar is used, the electrically conductive-auxiliary-coating-agent layer being formed by applying an electrically conductive auxiliary coating agent to the joining region of the conductive base material, wherein the joining region of the conductive base material is subjected to oxide film removing treatment before the electrically conductive-auxiliary-coating-agent layer is formed and has a surface roughness of 0.6 μm or less in terms of an arithmetic mean roughness Ra specified in JISB0601 (1994), wherein the electrically conductive auxiliary coating agent comprises conductive auxiliary grease containing one or two or more powders selected from the group consisting of chromium oxide, zinc, silicon carbide, and a bismuth-tin alloy, and wherein the bus bar has a bolt fastening hole at the joining region of the metallic conductive base material so that the bus bar is joined to said another conductive member.

2. The bus bar according to claim 1, wherein the electrically conductive-auxiliary-coating-agent layer has a thickness of 100 μm or less.

3. The bus bar according to claim 2, wherein the electrically conductive-auxiliary-coating-agent layer has a thickness of from 10 μm to 40 μm.

4. The bus bar according to claim 1, further comprising a removable protective cover disposed on the electrically conductive-auxiliary-coating-agent layer so that the removable protective cover covers and protects the electrically conductive-auxiliary-coating-agent layer and is removed when the bus bar is used.

5. The bus bar according to claim 4, wherein the removable protective cover comprises a release sheet formed into a film shape or a sheet shape to be releasably bonded to the electrically conductive-auxiliary-coating-agent layer.

6. The bus bar according to claim 5, wherein the removable protective cover covers an entire surface of a joining surface and a side surface of the electrically conductive-auxiliary-coating-agent layer.

7. The bus bar according to claim 4, wherein the removable protective cover comprises a guarding sheet for covering and protecting the joining region of the conductive base material and the electrically conductive-auxiliary-coating-agent layer formed on the joining region, the guarding sheet being formed into a tubular shape opened at both ends or a bag shape opened at one end.

8. The bus bar according to claim 4, wherein the removable protective cover comprises a guarding cover including a covering section for covering an entire surface of the electrically conductive-auxiliary-coating-agent layer and a locking section for detachably locking the covering section to the conductive base material.

9. The bus bar according to claim 1, wherein a material for the conductive base material comprises aluminum or an aluminum alloy.

10. The bus bar according to claim 1, wherein the oxide film removing treatment is chemical etching or mechanical processing.

11. The bus bar according to claim 1, wherein the electrically conductive-auxiliary-coating-agent layer has a thickness of from 11 μm to 33 μm.

12. The bus bar according to claim 1, wherein the joining region of the conductive base material has a surface roughness of 0.5 μm or less.

13. A bus bar joint structure, comprising:

the bus bar according to claim 1;

said another conductive member; and a bolt and a nut; wherein the joining region of the bus is joined to said another conductive member by the nut and the bolt so that the electrically conductive-auxiliary-coating-agent layer is placed between the bus bar and another conductive member.

* * * * *